US009758915B2

(12) United States Patent
Park et al.

(10) Patent No.: US 9,758,915 B2
(45) Date of Patent: Sep. 12, 2017

(54) WASHING MACHINE AND METHOD OF MANUFACTURING THE SAME

(71) Applicant: LG ELECTRONICS INC., Seoul (KR)

(72) Inventors: Soonan Park, Gyeongsangnam-do (KR); Dongwoo Kang, Gyeongsangnam-do (KR); Seongno Yoon, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 188 days.

(21) Appl. No.: 14/531,125

(22) Filed: Nov. 3, 2014

(65) Prior Publication Data

US 2015/0123522 A1 May 7, 2015

(30) Foreign Application Priority Data

Nov. 4, 2013 (KR) ..... 10-2013-0133141

(51) Int. Cl.
*D06F 37/24* (2006.01)
*D06F 37/20* (2006.01)
(Continued)

(52) U.S. Cl.
CPC ..... *D06F 37/24* (2013.01); *D06F 37/20* (2013.01); *D06F 37/26* (2013.01); *D06F 37/268* (2013.01);
(Continued)

(58) Field of Classification Search
CPC ..... D06F 37/12; D06F 37/20; D06F 37/26; D06F 37/268
See application file for complete search history.

(56) References Cited

U.S. PATENT DOCUMENTS 5,946,946 A * 9/1999 Sharp ..... D06F 37/20 188/129
6,151,930 A * 11/2000 Carlson ..... D06F 37/20 68/12.06
(Continued)

FOREIGN PATENT DOCUMENTS

CN 1199789 11/1998
CN 1275648 12/2000
(Continued)

OTHER PUBLICATIONS

Office Action issued in Chinese Application No. 201410614409.2 on Aug. 22, 2016, 17 pages (with English translation).

*Primary Examiner* — Joseph L Perrin
(74) *Attorney, Agent, or Firm* — Fish & Richardson P.C.

(57) ABSTRACT

A washing machine and a method for manufacturing the same are disclosed. A washing machine includes a casing that defines an outer appearance of the washing machine and an outer tub in the casing that is configured to receive water. A supporting rod is coupled with the casing, and a suspension is coupled with the outer tub, the supporting rod being inserted in the suspension. The suspension is configured to move bi-directionally along the supporting rod as the outer tub vibrates to mitigate vibration of the outer tub, and the suspension includes a frictional part configured to contact the supporting rod. The suspension is configured to apply a lubricating material to a portion of the supporting rod that is brought in contact, during the vibration of the outer tub, with the frictional part of the suspension.

7 Claims, 6 Drawing Sheets

(51) Int. Cl.
*D06F 37/26* (2006.01)
*D06F 37/12* (2006.01)

(52) U.S. Cl.
CPC ..... *D06F 37/12* (2013.01); *Y10T 29/49826* (2015.01)

(56) References Cited

U.S. PATENT DOCUMENTS

| | | | | |
|---|---|---|---|---|
| 6,397,643 | B1 * | 6/2002 | Chang | D04B 1/22 66/170 |
| 2002/0130453 | A1 * | 9/2002 | Roper | C08F 8/36 267/130 |
| 2004/0012132 | A1 * | 1/2004 | Roper | F16F 9/0209 267/118 |
| 2004/0100006 | A1 * | 5/2004 | Kawahara | F16F 9/0218 267/118 |
| 2011/0167878 | A1 * | 7/2011 | De Angelo Sanchez | D06F 37/268 68/212 |
| 2011/0247372 | A1 * | 10/2011 | Miller | D06F 37/12 68/13 R |

FOREIGN PATENT DOCUMENTS

| | | |
|---|---|---|
| CN | 101387061 | 3/2009 |
| CN | 101387062 | 3/2009 |
| CN | 101392446 | 3/2009 |
| CN | 102660854 | 9/2012 |
| KR | 10-0272587 | 12/2000 |

* cited by examiner

WASHING MACHINE AND METHOD OF MANUFACTURING THE SAME

CROSS-REFERENCE TO RELATED APPLICATION

Pursuant to 35 U.S.C. §119(a), this application claims the benefit of an earlier filing date and right of priority to Korean Patent Application No. 10-2013-0133141, filed on Nov. 4, 2013 in the Korean Intellectual Property Office, the contents of which are incorporated herein by reference in their entirety.

TECHNICAL FIELD

The present application relates to a washing machine and a method of manufacturing the same, and particularly, to a washing machine that reduces vibration that occurs while the washing machine is in operation.

BACKGROUND

Typically, a washing machine is an apparatus that washes objects using a softening effect of detergent, a water flow generated as the washing tub or washing blades rotate, and an impact exerted by the washing blades. A washing machine performs washing, rinsing, and/or dehydrating to remove contaminants from the objects to be washed (hereinafter, referred to as "laundry") through an interaction between the detergent and water.

SUMMARY

In one aspect, a washing machine includes a casing that defines an outer appearance of the washing machine; an outer tub provided in the casing and configured to receive water; a supporting rod coupled with the casing; and a suspension coupled with the outer tub, the supporting rod being inserted in the suspension. The suspension is configured to move bi-directionally along the supporting rod as the outer tub vibrates to mitigate vibration of the outer tub, and the suspension includes a frictional part configured to contact the supporting rod. The suspension is configured to apply a lubricating material to a portion of the supporting rod that is brought in contact, during the vibration of the outer tub, with the frictional part of the suspension.

Implementations may include one or more of the following features. In some implementations, the supporting rod includes a first frictional portion configured to contact the frictional part of the suspension based on the outer tub being stationary; a second frictional portion that is brought in contact with the frictional part of the suspension based on the outer tub vibrating; and a third portion corresponding to a lower side of the second frictional portion. The suspension is configured to apply the lubricating material over the first frictional portion and the second frictional portion.

In some implementations, the second frictional portion of the supporting rod includes a peak frictional part that is brought in contact with the frictional part of the suspension based on an amplitude of movement of the suspension along the supporting rod reaching a peak amplitude due to the vibration of the outer tub, and the suspension is further configured to, based on an external force greater than a predetermined force being applied to move the suspension along the supporting rod beyond the peak amplitude, expose the peak frictional part of the supporting rod to an outside of the suspension at an upper side of the frictional part of the suspension.

In some implementations, the suspension includes a storage unit that is located at the upper side of the frictional part of the suspension and that defines a space configured to store the lubricating material between the frictional part of the suspension and the supporting rod, and, based on the external force greater than the predetermined force being applied to move the suspension along the supporting rod beyond the peak amplitude, the peak frictional part of the supporting rod is pushed to an upper side of the storage unit and exposed to an outside of the suspension.

In some implementations, the second frictional portion of the supporting rod includes a normal frictional part N which corresponds to other portions of the supporting rod except the peak frictional part of the supporting rod, and on which the lubricating material is applied from the storage unit.

In another aspect, a washing machine includes a casing that defines an outer appearance of the washing machine, an outer tub provided in the casing and configured to receive water, a supporting rod coupled with the casing, and a suspension coupled with the outer tub, the supporting rod being inserted in the suspension. The suspension is configured to move bi-directionally along the supporting rod as the outer tub vibrates to mitigate vibration of the outer tub, and the suspension is configured to apply a lubricating material to a portion of the supporting rod that contacts the suspension. The suspension is configured to move bi-directionally along the supporting rod while the suspension is in frictional contact with the portion of the supporting rod on which the lubricating material is applied.

In some implementations, the suspension includes an air cap configured to move along the supporting rod as the outer tub vibrates, and a first elastic member is disposed in the air cap and is configured to elastically support the air cap at an upper end thereof. A base is disposed at an end of the supporting rod and configured to support a lower end of the first elastic member, and the base is configured to be insertable into the air cap.

In some implementations, the first elastic member is configured to exert a force such that an inner surface of the air cap is forced apart from the base.

In some implementations, the air cap includes a cylindrical part that defines a space configured to accommodate the first elastic member, a frictional part located at an end of the cylindrical part and configured to surround the supporting rod to create friction, a storage unit surrounding the supporting rod and forming a space configured to store the lubricating material between the supporting rod and the storage unit.

In some implementations, the storage unit is located at an upper side of the frictional part of the cylindrical part of the air cap and configured to supply the lubricating material to a space between the frictional part of the cylindrical part of the air cap and the supporting rod.

In some implementations, the air cap includes an air vent configured to discharge air located between an inner surface of the air cap and the base.

In some implementations, the base is configured to move along the supporting rod to compress air located in the air cap.

In some implementations, the washing machine further includes a second elastic member configured to expand the base to narrow a gap between an inner surface of the air cap and the base.

In another aspect, a washing machine includes a casing that defines an outer appearance of the washing machine, and an outer tub is provided in the casing and configured to receive water. An air cap is provided at an outer circumference of the outer tub and includes a space configured to accommodate air. A supporting rod is coupled with the casing and is configured to guide movement of the air cap as the outer tub vibrates, the air cap defining a space configured to store a lubricating material between the air cap and the supporting rod to block air located in the air cap from being discharged between the supporting rod and the air cap as the air cap moves.

In some implementations, the washing machine further includes a base provided in the supporting rod and configured to be moved by the supporting rod to compress air located in the air cap.

In some implementations, the air cap includes an air vent configured to discharge air from between the an inner surface of the air cap and the base as the base moves towards a peak position at which the base is maximally inserted in the air cap by the vibration of the outer tub.

In some implementations, the air cap includes a frictional part that surrounds the supporting rod and that is configured to create a frictional force with the supporting rod, and the air cap is configured to apply the lubricating material between the supporting rod and the frictional part based on the base reaching the peak position.

In some implementations, the washing machine further includes a first elastic member provided between the base and the air cap and elastically supporting the air cap.

In some implementations, the washing machine further includes a second elastic member configured to expand the base to narrow a gap between an inner surface of the air cap and the base.

In some implementations, a frictional member brought in frictional contact with the supporting rod is provided in the storage unit, the frictional member being soaked in the lubricating material.

In another aspect, a method of manufacturing a washing machine is disclosed. The washing machine includes a casing that defines an outer appearance of the washing machine, and an outer tub is provided in the casing configured to receive water. A supporting rod is coupled with the casing, and a suspension is coupled with the outer tub, wherein the supporting rod is configured to be insertable into the suspension, and the suspension is configured to move bi-directionally along the supporting rod as the outer tub vibrates to mitigate vibration of the outer tub. The suspension includes a frictional part configured to contact the supporting rod. The method of manufacturing the washing machine includes inserting the supporting rod in the frictional part of the suspension. The method also includes applying a force to expose, to an outside of the suspension, a portion of the supporting rod that contacts the frictional part of the suspension based on the outer tub reaching a maximum vibration amplitude within a preset vibration range of the outer tub, and applying a lubricating material to the exposed portion of the supporting rod.

The details of one or more implementations are set forth in the accompanying drawings and the description below. Other features will be apparent from the description and drawings, and from the claims. The description and specific examples below are given by way of illustration only, and various changes and modifications will be apparent.

DETAILED DESCRIPTION

The present disclosure relates to a washing machine and a method of manufacturing the same, and particularly, to a washing machine that may effectively reduce vibration that occurs while the washing machine is in operation. The washing machine may effectively reduce vibration even when the vibration of the outer tub varies. In some implementations, the washing machine may also have an increased capacity of the outer tub. In some implementations, the washing machine may have reduced noise and increased durability and stability.

The washing machine may reduce vibration of outer tub, and may, in some implementations, enable increased durability and stability and reduced noise. The washing machine may also reduce vibration of the outer tub in the vibration state.

A washing machine includes a casing forming its outer appearance, an outer tub hung in the casing, and an inner tub rotatably provided in the outer tub. The washing machine further includes a suspension to reduce vibration of the outer tub that occurs as the inner tub and/or pulsator rotates.

A washing machine may have a suspension structured to decrease the vibration that occurs from the outer tub using, e.g., elasticity/restoration force of spring and viscosity of fluid. A washing machine may have its suspension designed specifically for a normal vibration state, but may not provide satisfactory vibration reduction in the transient vibration state. In other words, although such suspension may respond to vibration in a normal state where the outer tub vibrates within a constant amplitude range, the suspension may be less effective during a transient vibration state in which the outer tub vibrates with a larger amplitude than that in the normal state. On the other hand, if a suspension system is designed to operate for the transient vibration state where a large amplitude occurs, the suspension system may show a deteriorated vibration reduction when operating in the normal vibration state with a relatively smaller amplitude.

The present disclosure describes techniques in which a washing machine may provide effective vibration mitigation for both a normal vibration state and a transient vibration state. Advantages and features of a washing machine according to the present disclosure will be more clearly understood from implementations described below with reference to the accompanying drawings. However, implementations are not limited to the following examples and may include various different forms. The implementations described in the following are provided as illustrative examples. Wherever possible, the same reference numbers will be used throughout the specification to refer to the same or like parts.

Hereinafter, some implementations are described in detail with reference to the accompanying drawings.

Figure 1:
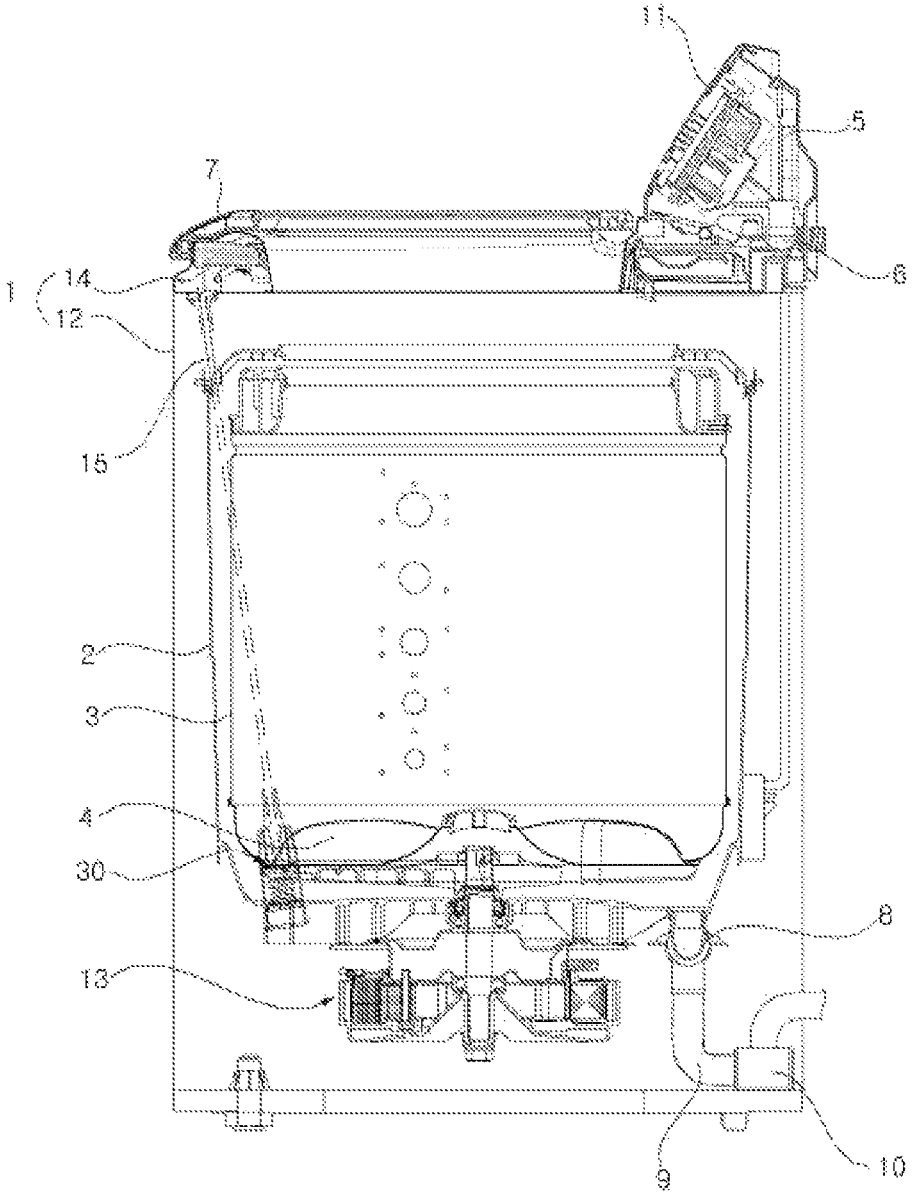
FIG. 1 is a cross-sectional view illustrating examples of main components of a washing machine according to some implementations.
Figure 2:
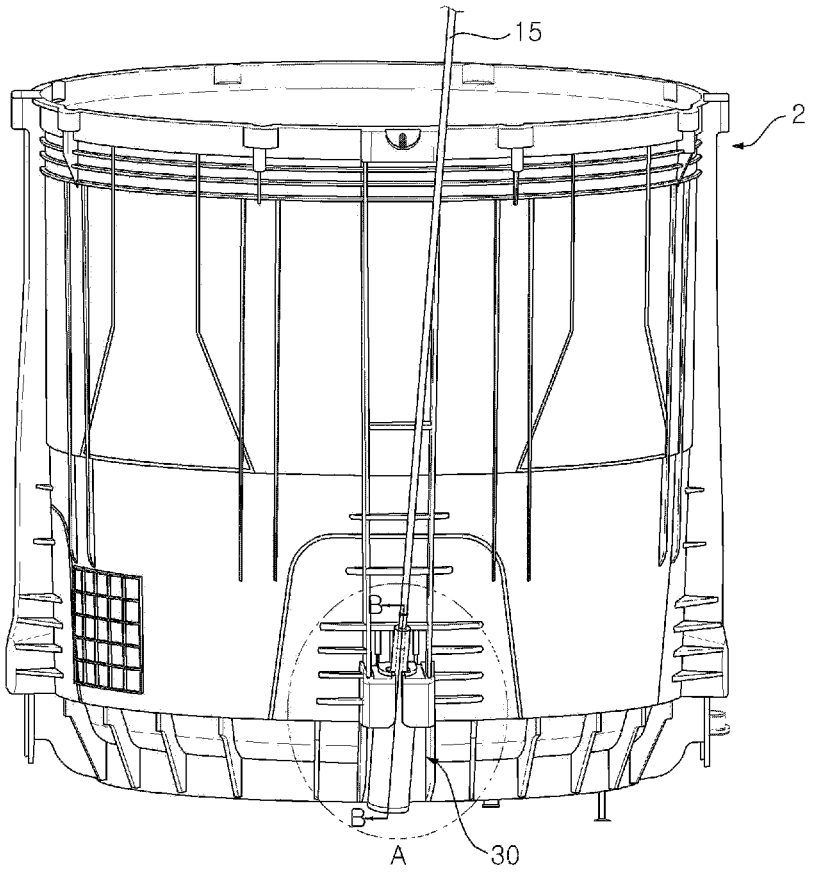
FIG. 2 is a partial perspective view illustrating an example configuration in which a suspension is added to the outer tub shown in FIG. 1.
Figure 3:
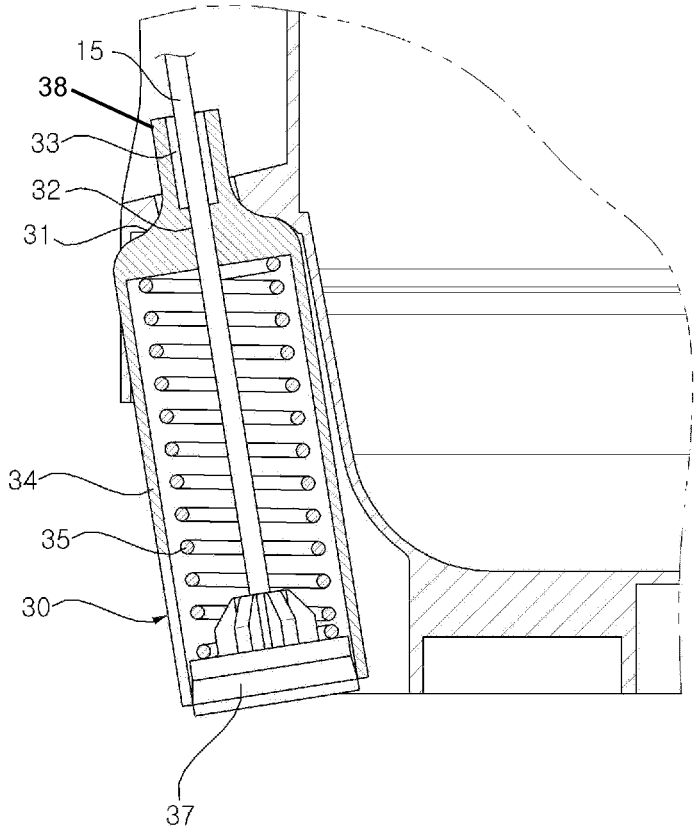
FIG. 3 is a cross-sectional view taken along line B-B of FIG. 2.
Figure 4:
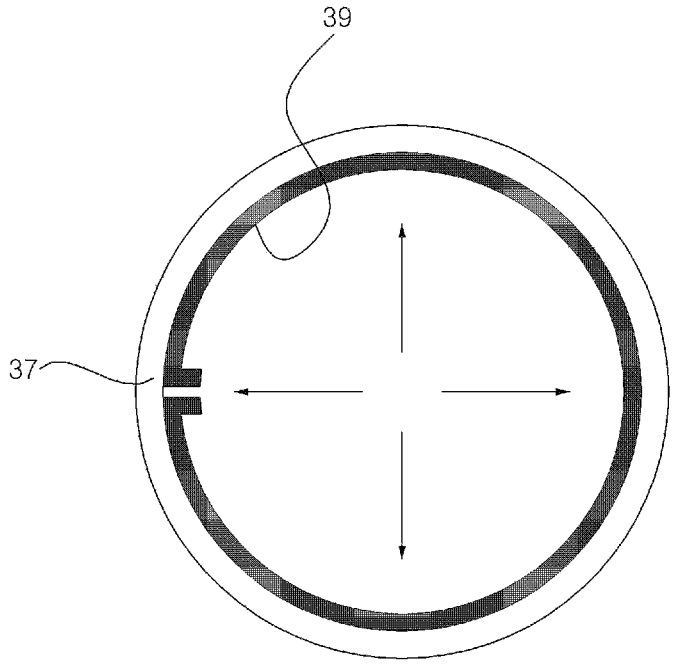
FIG. 4 is a lower side view illustrating the base shown in FIG. 3.

FIG. 1 illustrates examples of main components of a washing machine according to some implementations. FIG. 2 illustrates a configuration in which a suspension is added to the outer tub shown in FIG. 1. FIG. 3 is a cross-sectional view taken along line B-B of FIG. 2. FIG. 4 is a lower side view illustrating the base shown in FIG. 3.

Referring to FIGS. 1 to 4, according to some implementations, a washing machine includes a casing 1 forming its outer appearance; an outer tub 2 provided in the casing 1 to contain washing water; a supporting rod 15 coupled with the casing 1; and a suspension 30 coupled with the outer tub 2. The supporting rod 15 is inserted into the suspension 30. The suspension 30 moves to-and-fro along the supporting rod 15 as the outer tub 2 vibrates to mitigate the vibration of the outer tub 2. A lubrication (e.g., slideway oil) is applied to a portion of the supporting rod 15 that contacts the suspension 30. The suspension 30 moves to-and-fro while in friction with the slideway oil-applied portion.

The supporting rod 15 is connected to the casing 1. The supporting rod 15 is connected with the suspension 30. The suspension 30 absorbs the vibration of the outer tub 2. The suspension 30 generates frictional forces against the supporting rod 15 at a plurality of portions. The supporting rod 15 may contact a frictional member. A lubrication (e.g., slideway oil) is applied on the supporting rod 15. The slideway oil creates a viscous frictional force. The suspension 30 is mounted in the outer tub 2 and vibrates alongside the outer tub 2. The suspension 30 removes the vibration of the outer tub 2.

The casing 1 forms an outer appearance of the washing machine. The washing machine includes a control panel 11 having manipulation keys for receiving various control commands from the user and a display for displaying information on the operational state of the washing machine and providing a user interface and a door 7 rotatably provided in the casing 1 to open and close an entrance/exit hole (not shown) through which the laundry is entered and exited.

The outer tub 2 containing washing water is provided to be hung in the casing 1 by the supporting rod 15. An inner tub 3 is rotatably provided in the outer tub 2 to contain the laundry. A pulsator 4 is rotatably provided on the bottom of the inner tub 3. The inner tub 3 includes a plurality of perforations through which washing water passes.

Any casing may be included in the casing defined herein as long as the casing forms an outer appearance of the washing machine. In particular, the casing may be a rigid body motionlessly fixed to allow an end of the supporting rod 15 hanging the outer tub 2 in the casing to be fixed to the casing. The casing to be hereinafter mentioned is merely an example of a configuration forming the outer appearance of the washing machine, and it should be appreciated that the casing defined in the claims is not limited in range thereto.

The casing 1 includes a main body 12 with an upper side opened and a top cover 14 provided at an upper side of the main body 12 and having an entrance/exit hole at substantially the middle thereof to permit entrance/exit of the laundry.

An end of the supporting rod 15 may be fixed to either the main body 12 or the top cover 14. A supporting means (not shown) may be further provided to allow the supporting rod 15 to pivot as the outer tub 2 vibrates.

An end of the supporting rod 15 is connected with the casing 1, and another end thereof is connected with the outer tub 2 by the suspension 30. The suspension 30 connects the supporting rod 15 with the outer tub 2 and reduces the vibration of the outer tub 2 that occurs while the washing machine is in operation.

The suspension 30 may include an air cap 31 through which the other end of the supporting rod 15 passes and which is fixed to an outer circumferential lower part of the outer tub 2 to be coupled with the outer tub 2 and a base 37 disposed in the air cap 31 to attenuate the vibration of the outer tub 2 by a frictional force generated in association with at least one of the air cap 31 and the supporting rod 15 as the outer tub 2 vibrates. Meanwhile, in case the outer tub 2 significantly vibrates, e.g., when the rotational speed of the inner tub 3 is drastically increased or when the inner tub 3 rotates at high speed with the laundry unevenly placed, the lower-directional displacement of the air cap 31 is sharply increased. An elastic member is elastically deformed as the lower-directional displacement of the air cap 31 is increased, thus assisting in attenuating vibration.

In some implementations, a spring, which is one possible example of first elastic member 35, is inserted into the supporting rod 15. The suspension 30 may further include the base 37 disposed at the other end of the supporting rod 15 to support the first elastic member 35. Since an end of the first elastic member 35 (e.g., a spring) is supported by the base 37 and the other end thereof is restricted by the air cap 31, as the lower-directional displacement of the air cap 31 increases, the air cap 31 pushes the first elastic member 35 (e.g., a spring) downwards and the first elastic member 35 is compressed.

In contrast, as the upper-directional displacement of the outer tub 2 increases, the restoration force of the first elastic member 35 (e.g., a spring) acts to push the air cap 31 upwards, so that the air cap 31 interworks with the outer tub 2 while in tight contact with the outer tub 2. Such structure allows the air cap 31 and the outer tub 2 to be coupled with each other without necessarily requiring a separate coupling member for fixing the air cap 31 to the outer circumference of the outer tub 2.

The air cap 31 is shaped as substantially a cylinder. The air cap 31 is rendered to contain compressed air by the base 37. The base 37 is disposed at a lower end of the air cap 31. A storage unit 33 to be described below is formed at an upper end of the air cap 31.

The base 37 is mounted to the supporting rod 15. The base 37 moves alongside the supporting rod 15. The base 37 is inserted in the air cap 31. The base 37 pressurizes a first elastic member 35. A second elastic member 39 to be described below is inserted in the base 37.

The first elastic member 35 exerts a force in a direction in which an inner surface of the air cap 31 is spaced apart from the base 37. The first elastic member 35 exerts an elastic force in a direction in which the base 37 is pushed away. The first elastic member 35 may be a coil spring. The base 37 penetrates the first elastic member 35.

The air cap 31 includes a cylindrical part 34 forming a space for accommodating the first elastic member 35; a frictional part 32 formed at an end of the cylindrical part 34 to surround the supporting rod 15 to create friction; and a storage unit 33 surrounding the supporting rod 15 and forming a space for storing lubrication material (e.g., a slideway oil) between the supporting rod 15 and the storage unit 33.

The base 37 is inserted in the cylindrical part 34. The cylindrical part 34 has a bottle neck part 38 at an upper end thereof. The frictional part 32 and the storage unit 33 are formed in the bottle neck part. The bottle neck part supports the outer tub 2. The bottle neck part is stuck in the outer circumference of the outer tub 2. The frictional part 32 abuts the supporting rod 15, and thus, a kinetic frictional force acts between the frictional part 32 and the supporting rod 15 as the outer tub 2 vibrates. A frictional member is disposed in the storage unit 33. The frictional member may be formed of fabric such as felt. The frictional member may be soaked in the slideway oil. The slideway oil is a fluid used to ease the motion of sliding surface-contact structures. Too high viscosity of the slideway oil may hamper the operation of the structures. Accordingly, a thin layer of slideway oil having a relatively low viscosity is applied upon use. The slideway oil is stored in the storage unit 33.

The storage unit 33 is provided at an upper side of the frictional part 32 and supplies the slideway oil to the supporting rod 15 oriented to the frictional part 32. The slideway oil abuts the supporting rod 15 to create a viscous frictional force. The storage unit 33 is larger in inner diameter than the frictional part 32. The base 37 does not contact the supporting rod 15. The slideway oil stored in the storage unit 33 seeps into a space between the frictional part 32 and the supporting rod 15.

The air cap 31 forms an air vent 40 through which the air accommodated between the air cap 31 and the base 37 is discharged. An air vent is formed in the air cap 31. The compressed air in the air cap 31 is discharged through the air vent. As the size of the air vent 40 decreases, the amount of compressed air discharged per hour reduces. As the size of the air vent 40 decreases, the damping force increases. The size of the air vent 40 depends on the sealing capacity of the storage unit 33. As the sealing capacity of the storage unit 33 increases, the air vent 40 is formed to have a small size. As the sealing capacity of the storage unit 33 decreases, the air vent 40 is formed to have a relatively large size.

The base 37 moves along the supporting rod 15 to compress the air contained in the air cap 31. The base 37 moves alongside the supporting rod 15.

Meanwhile, as shown in the example of FIG. 4, a second elastic member 39 may be further provided to expand the base 37 to narrow the gap between the air cap 31 and the base 37. The second elastic member 39 may be shaped as a ring. The second elastic member 39 elastically pushes the outer periphery of the base 37 outwards, and the base 37 may be thus brought in more tight contact with the air cap 31. As the elastic force of the second elastic member 39 increases, the frictional force between the base 37 and the air cap 31 also increases.

In some implementations, a sealing material (e.g., sealing oil) may be accommodated in the storage unit 33. The sealing oil may, in some implementations, be lubrication (e.g., a slideway oil). However, the sealing material is not limited thereto, and other various types of materials may be used for the sealing material. According to some implementations, a frictional member may be disposed in the storage unit 33. The frictional member suppresses the supporting rod 15 from moving. The frictional member may be felt. In particular, felt soaked in the slideway oil may provide an effective sealing between the air cap 31 and the supporting rod 15.

Figures 5, 5A, 5B, 5C:
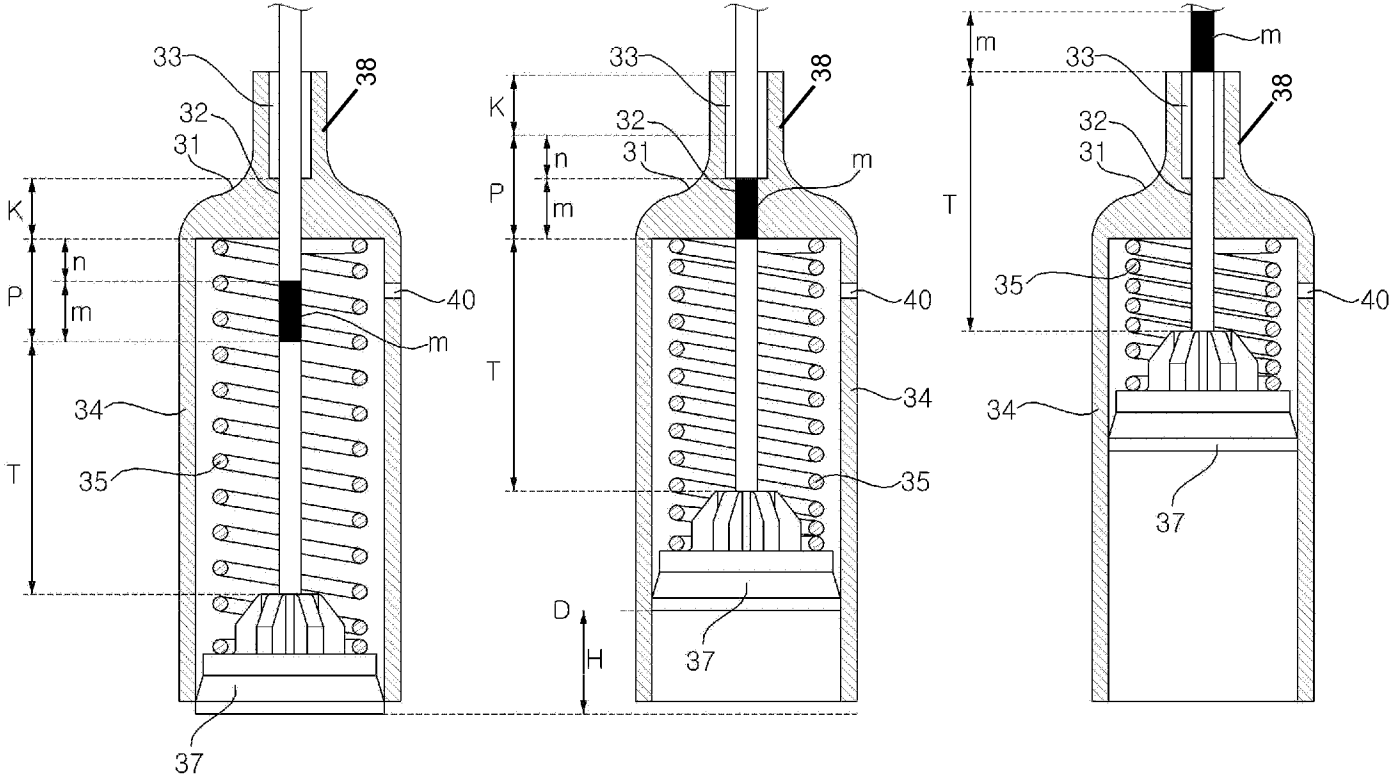
FIGS. 5A, 5B, and 5C are views illustrating an example of an operational relationship of a suspension according to some implementations.

FIG. 5A shows a state where the outer tub 2 does not vibrate, FIG. 5B shows a state where the outer tub 2 maximally vibrates, and FIG. 5C shows a position at which a slideway oil is applied to ensure a damping force under the state shown in FIG. 5B.

Referring to FIGS. 1 to 5C, if the position where the base 37 is maximally inserted in the air cap 31 by the vibration of the outer tub 2 is defined as a peak position, when the base 37 reaches the peak position, the air in the air cap 31 is maximally compressed. In particular, the peak position may vary depending on the load exerted to the suspension 30. For example, when the outer tub 2 vibrates with the maximum load under the circumstance where the other conditions than varying load of the outer tub 2 remains the same, the outer tub 2 may descend up to the lowermost side of the supporting rod 15. When the outer tub 2 maximally vibrates under such particular load condition, a partial section of the supporting rod 15 abutting the frictional part 32 is hereinafter defined as a peak friction part M. In particular, the peak frictional part M is positioned at an inner side of the cylindrical part 34 without contacting the frictional part 32 under a no-load state (i.e., when the laundry is not put in the inner tub 3 and no water is fed in the outer tub 2) (refer to FIG. 5A), and at least a portion thereof is brought in frictional contact with the frictional part 32 when the outer tub 2 vibrates under the maximum load state.

In some implementations, the peak frictional part M comes in contact with the frictional part 32 (refer to FIG. 5B) before the first elastic member 35 is fully compressed, and at least a portion thereof is exposed to an upper side of the air cap 31 when the first elastic member 35 is fully compressed.

In some implementations, the first elastic member 35 may be exposed to the upper side of air cap 31 while the outer tub 2 vibrates. However, the length of the bottle-neck part of the air cap 31 and/or elastic modulus of the first elastic member 35 are designed so that a frictional force is exerted between the supporting rod 15 and the frictional part 32 even when the outer tub 2 maximally vibrates (when the base 37 reaches the peak position), and in such case, an external force may be thus exerted to allow the air cap 31 and the base 37 to be displaced with respect to each other in order to force the peak frictional part M to be exposed to the upper side of the air cap 31. Such forced exposure of the peak frictional part M to the upper side of the air cap 31 by an external force corresponds to when applying the slideway oil contained in the storage unit 33 to the peak frictional part M, and the exposure is executed upon manufacture of the product or for maintenance of the product in use.

The peak position may vary depending on the elastic force exerted from the first elastic member 35. For example, since the amplitude of the base 37 reduces as the elastic force of the first elastic member 35 increases, the base 37 may be located at a lower position in the air cap 31. In contrast, as the elastic force of the first elastic member 35 reduces, the amplitude of the base 37 increases, thus allowing the base 37 to be positioned at an upper side in the air cap 31.

The lubrication (e.g., the slideway oil) may be applied to the supporting rod 15. In some implementations, the slideway oil is applied to an overall portion of the supporting rod 15 that is brought in contact with the frictional part 32 by the vibration of the outer tub 2.

As shown in the example of FIG. 5, the supporting rod 15 may be divided into a first frictional portion K which contacts the frictional part 32 when the outer tub 2 does not vibrate; a second frictional portion P which is brought in contact with the frictional part 32 of the air cap 31 when the outer tub 2 vibrates; and a third portion T corresponding to a lower side of the second frictional portion P. In particular, the third portion T is hereinafter referred to as a frictionless portion T that does not come in contact with the frictional part 32 of the air cap 31 when the outer tub 2 normally vibrates. The length of the frictionless portion T may be determined depending on the first elastic member 35 when fully compressed, the capacity of the outer tub 2, and threshold amplitude of the overall vibrational system. When the supporting rod 15 is divided so, the slideway oil is applied to at least the first frictional portion K and the second frictional portion P.

The second frictional portion P includes a peak frictional part M that is brought in contact with the frictional part 32 of the air cap 31 when the amplitude of movement of the supporting rod 15 reaches the peak amplitude due to the vibration of the outer tub 2. The suspension 30 is structured so that when an external force enough to fully compress the first elastic member 35 is applied, the peak frictional part M is exposed via the frictional part 32 of the air cap 31 to the outside (e.g., in FIG. 5C). The suspension 30 includes the storage unit 33 that is formed at an upper side of the frictional part 32 of the air cap 31 and that forms a space for storing the slideway oil between the frictional part 32 of the air cap 31 and the supporting rod 15. In the scenario of FIG. 5C, the suspension 30 is formed so that the peak frictional part M is pushed to the outside of the storage unit 33 to be externally exposed. The slideway oil, which is stored in the storage unit 33 and supplies the slideway oil to the supporting rod 15 moving to-and-fro, is thus applied to the peak frictional part M, but may be applied to the frictionless portion T. As described above, this corresponds to a scenario of applying the slideway oil contained in the storage unit 33 to the peak frictional part M, and may be executed, for example, upon manufacture of the product or for maintenance of the product in use.

The second frictional portion P includes the peak frictional part M and a normal frictional part N. The normal frictional part N is a section of the second frictional portion P except the peak frictional part M. If the outer tub 2 vibrates, the frictional part 32 is primarily brought in contact with the normal frictional part N, and as the vibration increases, the frictional part 32 starts to cause friction with a portion of the peak frictional part M. If the vibration of the outer tub 2 reaches the peak, the frictional part 32 causes friction on the entire peak frictional part M. In the washing machine according to some implementations, thus, the slideway oil is applied to the peak frictional part M to secure a stable damping force.

The slideway oil is stored in the storage unit 33. According to some implementations, the peak frictional part M may rise as high as the storage unit 33, thus applying the slideway oil to the peak frictional part M. According to some implementations, the peak frictional part M may ascend beyond an upper side of the storage unit 33 to be externally exposed. The first elastic member 35 included in the suspension 30 may restrict the height up to which the supporting rod 15 may ascend.

The second frictional portion P includes a normal frictional part N which corresponds to the rest except the peak frictional part M on which the slideway oil is applied from the storage unit 33. If the peak frictional part M descends, a majority of the slideway oil applied to the peak frictional part M is rendered to remain in the storage unit 33. The remaining slideway oil in the storage unit 33 is brought in contact with the normal frictional part N, and thus, the slideway oil is applied on the normal frictional part N.

The position of the peak frictional part M and the position of the normal frictional part N may vary depending on the elastic modulus of the first elastic member 35 and the second elastic member 39, the size of the air vent 40, the viscosity coefficient of the slideway oil, and degree of vibration of the outer tub 2. Accordingly, proper positions may be derived by one of ordinary skill in the art based on the configuration of the washing machine.

Figure 6:
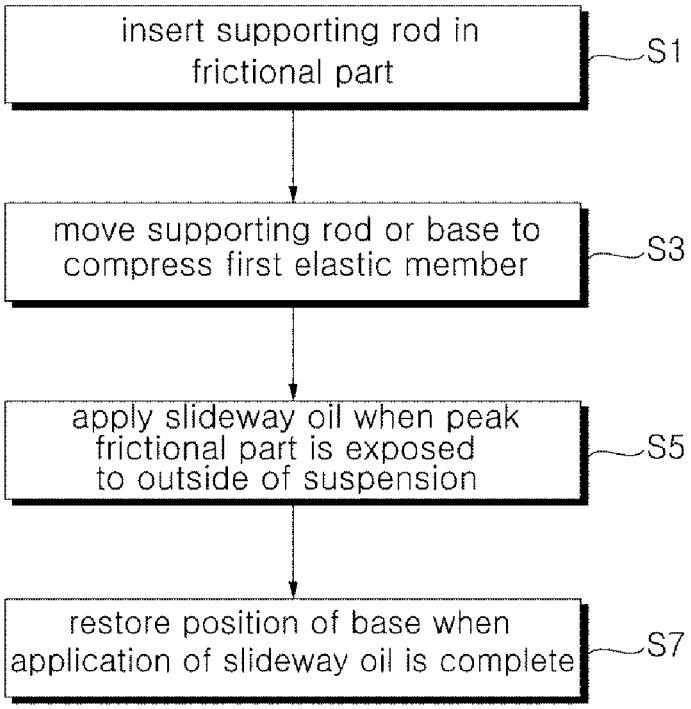
FIG. 6 is a flowchart illustrating an example of a method of manufacturing a washing machine according to some implementations.

FIG. 6 illustrates a method of manufacturing a washing machine according to some implementations.

Referring to FIG. 6, a method of manufacturing a washing machine including a casing 1 forming its outer appearance; an outer tub 2 provided in the casing 1 to contain washing water; a supporting rod 15 coupled with the casing 1; and a suspension 30 coupled with the outer tub 2, wherein the supporting rod 15 is inserted into the suspension 30, and the suspension 30 moves to-and-fro along the supporting rod 15 as the outer tub 2 vibrates to mitigate the vibration of the outer tub 2, and wherein the suspension includes a frictional part contacting the supporting rod is shown. According to some implementations, the method includes the steps of (S1) inserting the supporting rod 15 in the frictional part 32; (S2) exposing, to an outside of the suspension 30, a first frictional portion K which contacts the frictional part 32 when the outer tub 2 does not vibrate and a second frictional portion P which contacts the frictional part 32 when the outer tub 2 vibrates; and (S5) applying a slideway oil to the supporting rod 15 exposed to the outside of the suspension 30.

For assembly, the supporting rod 15 is inserted into the frictional part 32 formed in the suspension 30. A first frictional member may be disposed before or after the supporting rod 15 is inserted. A base 37 is mounted at an end of the supporting rod 15. Under such state, the first frictional portion K, the second frictional portion P, and a frictionless portion T remain inserted in the suspension 30.

For application of the slideway oil, a force is exerted to the base 37 or the supporting rod 15 in a direction along which the first elastic member 35 is compressed. The force is exerted to the supporting rod 15 or the base 37 substantially until the peak frictional part M is externally exposed (S3). If the peak frictional part M is exposed, the slideway oil is applied to the peak frictional part M (S5). If the application of slideway oil is complete, the base 37 is restored to the original state (S7).

In order to keep the damping force stable, the slideway oil may be applied to a portion where the suspension 30 and the supporting rod 15 contact each other at a peak position D. The slideway oil may be applied to a portion of the supporting rod 15, which contacts the frictional part 32 when the base 37 is placed at the peak position D, (the portion is hereinafter referred to as the peak frictional part M). Accordingly, upon application of the slideway oil, the peak frictional part M may be positioned at a higher level than the frictional part 32, at least. In some implementations, the slideway oil may be applied to the peak frictional part M while positioned at the storage unit 33 or at an upper side of the storage unit 33.

Although some implementations have been disclosed for illustrative purposes, those skilled in the art will appreciate that various modifications, additions and substitutions are possible, without departing from the scope and spirit of the invention as disclosed in the accompanying claims.

What is claimed is:

1. A washing machine, comprising:

a casing that defines an outer appearance of the washing machine;

an outer tub provided in the casing and configured to receive water;

a supporting rod coupled with the casing; and a suspension coupled with the outer tub, the supporting rod being inserted in the suspension, wherein the suspension is configured to move bi-directionally along the supporting rod as the outer tub vibrates to mitigate vibration of the outer tub, wherein the suspension includes a frictional part configured to contact the supporting rod, wherein the suspension is configured to apply a lubricating material to a portion of the supporting rod that is brought in contact, during the vibration of the outer tub, with the frictional part of the suspension, wherein the supporting rod includes:

a first frictional portion configured to contact the frictional part of the suspension based on the outer tub being stationary;

a second frictional portion that is brought in contact with the frictional part of the suspension based on the outer tub vibrating; and a third portion corresponding to a lower side of the second frictional portion, wherein the suspension is configured to apply the lubricating material over the first frictional portion and the second frictional portion, wherein the second frictional portion of the supporting rod includes a peak frictional part that is brought in contact with the frictional part of the suspension based on an amplitude of movement of the suspension along the supporting rod reaching a peak amplitude due to the vibration of the outer tub, wherein the suspension is further configured to, based on an external force greater than a predetermined force being applied to move the suspension along the supporting rod beyond the peak amplitude, expose the peak frictional part of the supporting rod to an outside of the suspension at an upper side of the frictional part of the suspension, wherein the suspension includes a storage unit that is located at the upper side of the frictional part of the suspension and that defines a space configured to store the lubricating material between the frictional part of the suspension and the supporting rod, and wherein, based on the external force greater than the predetermined force being applied to move the suspension along the supporting rod beyond the peak amplitude, the peak frictional part of the supporting rod is pushed to an upper side of the storage unit and exposed to an outside of the suspension.

2. The washing machine of claim 1, wherein the second frictional portion of the supporting rod comprises a normal frictional part which corresponds to other portions of the supporting rod except the peak frictional part of the supporting rod, and on which the lubricating material is applied from the storage unit.

3. A washing machine, comprising:

a casing that defines an outer appearance of the washing machine;

an outer tub provided in the casing and configured to receive water;

a supporting rod coupled with the casing; and a suspension coupled with the outer tub, the supporting rod being inserted in the suspension, wherein the suspension is configured to move bi-directionally along the supporting rod as the outer tub vibrates to mitigate vibration of the outer tub, wherein the suspension is configured to apply a lubricating material to a portion of the supporting rod that contacts the suspension, wherein the suspension is configured to move bi-directionally along the supporting rod while the suspension is in frictional contact with the portion of the supporting rod on which the lubricating material is applied, wherein the suspension includes:

an air cap configured to move along the supporting rod as the outer tub vibrates;

a first elastic member disposed in the air cap and configured to elastically support the air cap at an upper end thereof; and a base disposed at an end of the supporting rod and configured to support a lower end of the first elastic member, wherein the base is configured to be insertable into the air cap, wherein the air cap includes:

a cylindrical part that defines a space configured to accommodate the first elastic member;

a frictional part located at an end of the cylindrical part and configured to surround the supporting rod to create friction; and a storage unit surrounding the supporting rod and forming a space configured to store the lubricating material between the supporting rod and the storage unit, wherein the storage unit is located at an upper side of the frictional part of the cylindrical part of the air cap and configured to supply the lubricating material to a space between the frictional part of the cylindrical part of the air cap and the supporting rod, wherein the supporting rod includes:

a first frictional portion configured to contact the frictional part of the suspension based on the outer tub being stationary;

a second frictional portion that is brought in contact with the frictional part of the suspension based on the outer tub vibrating; and a third portion corresponding to a lower side of the second frictional portion, wherein the second frictional portion of the supporting rod includes a peak frictional part that is brought in contact with the frictional part of the suspension based on an amplitude of movement of the suspension along the supporting rod reaching a peak amplitude due to the vibration of the outer tub, wherein the suspension is further configured to, based on an external force greater than a predetermined force being applied to move the suspension along the supporting rod beyond the peak amplitude, expose the peak frictional part of the supporting rod to an outside of the suspension at an upper side of the frictional part of the suspension, and wherein, based on the external force greater than the predetermined force being applied to move the suspension along the supporting rod beyond the peak amplitude, the peak frictional part of the supporting rod is pushed to an upper side of the storage unit and exposed to an outside of the suspension.

4. The washing machine of claim 3, wherein the first elastic member is configured to exert a force such that an inner surface of the air cap is forced apart from the base.

5. The washing machine of claim 3, wherein the air cap includes an air vent configured to discharge air located between an inner surface of the air cap and the base.

6. The washing machine of claim 3, wherein the base is configured to move along the supporting rod to compress air located in the air cap.

7. The washing machine of claim 6, further comprising a second elastic member configured to expand the base to narrow a gap between an inner surface of the air cap and the base.

* * * * *